US006568995B1

(12) United States Patent
Mitani et al.

(10) Patent No.: US 6,568,995 B1
(45) Date of Patent: May 27, 2003

(54) METHOD FOR CLEANING GLASS SUBSTRATE

(75) Inventors: Kazuishi Mitani, Osaka (JP); Yasuhiro Saito, Osaka (JP)

(73) Assignee: Nippon Sheet GLass Co., Ltd., Osaka (JP)

( * ) Notice: Subject to any disclaimer, the term of this patent is extended or adjusted under 35 U.S.C. 154(b) by 83 days.

(21) Appl. No.: 09/699,339

(22) Filed: Oct. 31, 2000

(30) Foreign Application Priority Data

Nov. 18, 1999 (JP) ..... 11-328522
Jul. 4, 2000 (JP) ..... 2000-202522

(51) Int. Cl.[7] ..... B24B 7/24
(52) U.S. Cl. ..... 451/36; 451/41; 51/309
(58) Field of Search ..... 451/36, 41, 42; 51/307, 309, 293; 106/3; 510/163, 180, 181, 397

(56) References Cited

U.S. PATENT DOCUMENTS 4,343,116 A * 8/1982 Murphy et al. ..... 134/2
4,563,494 A * 1/1986 Ida ..... 376/288
5,308,803 A * 5/1994 Clifford et al. ..... 428/701
5,725,625 A * 3/1998 Kitayama et al. ..... 65/117
5,871,654 A * 2/1999 Mannami et al. ..... 216/22
6,030,491 A * 2/2000 Vaartstra ..... 216/79
6,095,161 A * 8/2000 Vaartstra ..... 134/1.3
6,207,630 B1 * 3/2001 Vaartstra ..... 438/633
6,248,143 B1 * 6/2001 Masuda et al. ..... 106/3
6,299,659 B1 * 10/2001 Kido et al. ..... 106/3
6,336,945 B1 * 1/2002 Yamamoto et al. ..... 106/3
6,375,754 B1 * 4/2002 Vaartstra ..... 134/2

FOREIGN PATENT DOCUMENTS

JP 50-45465 4/1975
JP 403242352 A * 10/1991 ..... C03C/23/00
JP 405200673 A * 8/1993 ..... B24D/3/00
JP 9-22885 1/1997
JP 410176164 A * 6/1998 ..... C09K/3/14
JP 10-199047 7/1998
JP 11-251280 8/1999
JP 2001229531 A * 8/2001 ..... G11B/5/84

* cited by examiner

*Primary Examiner*—Joseph J. Hail, III
*Assistant Examiner*—David B. Thomas
(74) *Attorney, Agent, or Firm*—Kanesaka & Takeuchi

(57) ABSTRACT

After a polishing process of polishing a glass substrate with an abrasive containing lanthanoid oxides, the glass substrate is subjected to the first and second washing processes. In the first washing process, the polished substrate is washed with a washing solution containing acid and a reducing agent, wherein the acid includes at least nitric acid. In the second washing process, the washed substrate is treated with an aqueous solution of an alkaline detergent. The substrate is suitable for a recording medium.

9 Claims, No Drawings

METHOD FOR CLEANING GLASS SUBSTRATE

FIELD OF THE INVENTION AND RELATED ART STATEMENT

The present invention relates to a method for cleaning a glass substrate and, more particularly, a glass substrate for use in a magnetic recording disc or a liquid crystal display, to which a high level of cleanliness is required.

In a multi-component glass substrate which is used as glass substrate for a magnetic recording disc or a liquid crystal display, a glass substrate is polished subsequent to formation process of the substrate, with using abrasive such as cerium oxide in order to ensure a high smoothness.

However, when the aforementioned glass substrate is polished with the abrasive, abrasive grains often remain sticking on the substrate surface firmly, which causes problems such as pinhole formation in subsequent processes. The abrasive grains firmly sticked to the substrate surface are very difficult to be removed by washing with water or neutral detergent. Consequently, the substrate has been washed with a liquid agent having etching ability, such as hydrofluoric acid (Japanese patent publication S50-45465A).

However, the hydrofluoric acid described in the above 50-45465 publication is still inadequate for giving a sufficiently clean glass substrate. This is because the glass substrate has a property to be positively charged in hydrofluoric acid solution, while various contamination particles including abrasive grains have a property to be negatively charged in hydrofluoric acid. Therefore, once removed contamination including abrasive grains can be adsorbed again onto the glass substrate, resulting in the glass substrate with insufficient cleanliness.

It is described in "Optical Glass (by Tetsuro Izumiya, published by Kyoritsu Shuppan) P. 165" that, when a glass substrate is washed with commercial alkaline detergent only, the contamination by the abrasive grains remains on the substrate surface, while complete removal of contamination accompanies glass corrosion, resulting in the rough substrate surface.

When the glass substrate with the rough surface, or with remaining abrasive grains, is layered with a magnetic film or a conducting film, the resulting disc may have difficulties in reading-out and writing-in, or it may give lettering errors due to discharging.

A magnetic recording device has been reduced in a distance between a magnetic head thereof and the substrate in pursuit of higher recording density, so that the contaminant particles on the substrate surface or the rough surface of the substrate possibly cause a head crush, that is, the head possibly collides with the particles or protrusions on the substrate surface during reading-out/writing-in operation. As a result, the demand for the cleanliness and smoothness of the substrate surface has increased.

Japanese patent publication H9-22885A describes a method to remove abrasive grains of cerium oxide on the substrate surface with using a washing solution containing sulfuric acid-hydrogen peroxide, hydrochloric acid-hydrogen peroxide, or nitric acid. In this method, the zeta-potential of the cerium oxide grains is changed by the above washing solution so that the remaining abrasive grains agglomerate to form larger particles which are easily removed in a subsequent scrubbing-washing process.

The purpose of the method described in the above 9-22885 publication is to agglomerate the cerium oxide particles by means of zeta-potential control in order to make them easily removable in the scrubbing-washing process. This is different from the purpose of the present invention in which cerium oxide removal is achieved by dissolution thereof by an action of a reducing agent and acid. Further, the scrubbing-washing process is not necessary in the method of a present invention, as the particles such as cerium oxide particles are removed by dissolution, while the scrubbing-washing process is indispensable in the method described in the 9-22885 publication.

In addition, the object of the present invention is in the cleaning of the glass substrate, while the object of the method described in the 9-22885 publication is in the cleaning of a semiconductor substrate, without any mention to the glass substrate.

OBJECT AND SUMMARY OF THE INVENTION

It is an object of the present invention to solve conventional problems as described above, and to provide a method of cleaning a glass substrate of high cleanliness for use in a magnetic disc and in a liquid crystal display, without occurrence of latent flaws and residual contaminant on the substrate surface.

The glass substrate of the present invention has a lanthanoid oxides quantity of less than $50\times10^{10}$ molecules/cm$^2$ remaining on the substrate surface.

The lanthanoid oxides include cerium oxide, lanthanum oxide, neodymium oxide, and praseodymium oxide. The lanthanoid oxides remaining on the substrate surface is particularly preferable in a range less than $0.5\times10^{10}$ molecules/cm$^2$.

Such glass substrate having very small quantity of lanthanoid oxides remaining on the substrate surface is extremely preferable to be used as an information recording medium. Further, the substrate according to the present invention has a surface which is not excessively rough. This is also the reason why it is suitable as the information recording medium.

According to the method for cleaning the glass substrate of the present invention, the glass substrate polished with an abrasive containing lanthanoid oxides, and then the substrate is washed with a washing solution containing acid and reducing agent.

DETAILED DESCRIPTION OF PREFERRED EMBODIMENTS

The glass composing the substrate of the present invention includes soda lime glass, aluminosilicate glass, borosilicate glass, aluminoborosilicate glass, and crystal glass from these kinds of glass. The aluminosilicate glass is preferable as a glass substrate for magnetic recording discs in respect of weathering property and cost. A preferable composition of aluminosilicate glass is as follows, expressed in molar fraction;

| | |
|---|---|
| $SiO_2$ | 63–70 mol % |
| $Al_2O_3$ | 6–12.5 mol % |
| $Li_2O$ | 5–11 mol % |
| $Na_2O$ | 6–14 mol % |
| $K_2O$ | 0–2 mol % |
| $TiO_2$ | 0–5 mol % |

-continued

| | |
|---|---|
| $ZrO_2$ | 0–2.5 mol % |
| MgO | 0–4.5 mol % |
| CaO | 2–7.5 mol % |
| SrO | 0–3 mol % |
| BaO | 0–2 mol % |

(The sum of MgO, CaO, SrO, BaO should be 2–12 mol %.)

The surface layer of the glass substrate may be modified. For example, the substrate may have a compression stressed surface layer formed by chemical strengthening treatment.

In polishing and washing processes which will be later explained in more detail, the substrate is finished to a surface roughness Ra less than 0.5 nm, and particularly less than 2.5 nm, and to an amount of lanthanoid oxides remaining on the surface of less than $50\times10^{10}$ molecules/$cm^2$, and particularly less than $0.5\times10^{10}$ molecules/$cm^2$. When Ra is greater than 0.5 nm, pointed protrusions called asperity are formed on the substrate surface. The substrate of the invention with the smooth surface and the very small quantity of lanthanoid oxides remaining on the surface is extremely preferable as an information recording medium.

In order to polish the substrate, an abrasive containing lanthanoid oxides is used. Examples of the abrasive include an abrasive containing cerium oxide as main component, and a powder abrasive which is produced by pulverizing calcinated natural ore bastnaesite consisting mainly of lanthanoid oxides (such as cerium oxide, lanthanum oxide, neodymium oxide, and praseodymium oxide).

There is no particular limitation in polishing method itself and various polishing apparatus can be used.

Subsequent to the polishing process, the substrate is washed with a washing solution containing acid and a reducing agent. There is no special limitation in the kind of acid, but in respect of dissolving ability to lanthanoid oxides, it is preferable to use at least one selected from nitric acid, sulfuric acid, hydrochloric acid, sulfamic acid, and phosphoric acid.

It is preferable to use one or more strong acids, particularly sulfuric acid, hydrochloric acid, or nitric acid. The acid concentration in the washing solution is preferably from 0.001 to 10 mol/L, more preferably from 0.001 to 0.5 mol/L. An acid concentration lower than 0.001 mol/L tends to give insufficient washing effect, and an acid concentration higher than 10 mol/L tends to cause an excessive etching of the substrate surface. It is particularly preferable to use nitric acid at a concentration from 0.001 to 0.5 mol/L, particularly from 0.1 to 0.5 mol/L. A nitric acid concentration lower than 0.1 mol/L may shorten the service life of the washing solution. Nitric acid is more preferable when it is used together with a reducing agent, because in this combination, the acid can rapidly dissolve lanthanoid oxides (such as cerium oxide, lanthanum oxide, neodymium oxide, and praseodymium oxide) which are the main components of the abrasive. In this case, a nitric acid with acid concentration as low as 0.1 N maintains a sufficient washing ability, which is preferable in respect of emission treatment.

Lanthanoid oxides can be dissolved to some extent in the washing solution which contains nitric acid, sulfuric acid, hydrochloric acid, sulfamic acid, or phosphoric acid without a reducing agent. However, when a reducing agent is added in the washing solution, lanthanoid oxides are reduced to become easily dissolvable. Nitric acid is particularly preferable in that the acid, which usually behaves as oxidizing agent, changes to nitrous acid by the action of reducing agent, to develop a full dissolving ability acting in synergism with the reduction of lanthanoid oxides, while the corrosion of stainless steel often used as washing tank material is kept low. The reducing agent preferably used for the present invention is at least one of such compounds as hydrogen, hydrogen peroxide, boron sodium hydroxide, hydroxylamin sulfate, hydroxylamin hydrochloride, sodium nitrite, sodium sulfite, sodium bisulfite, sodium bisulfate, sodium sulfide, ammonium sulfide, formic acid, ascorbic acid, oxalic acid, acetaldehyde, hydrogen iodide, sodium hydrogen phosphate, disodium hydrogen phosphate, sodium phosphite, ferrous sulfate, and tin(IV) chloride, as well as chelating agents (e.g. oxide of catechol genus) possessing reducing property. Ascorbic acid is particularly preferable, also acting as chelating agent.

Sodium sulfite, sodium bisulfite, and oxalic acid are preferable reducing agents next to ascorbic acid. An example of preferable chelating agent other than ascorbic acid is muconic acid.

The concentration of the reducing agent in the washing solution is preferably from 1 to 5 mol/L for hydrogen peroxide, and 0.0001 to 0.1 mol/L for other reducing agents.

In a system where hydrogen peroxide is used, a concentration of hydrogen peroxide lower than 1 mol/L gives too low dissolving ability, while a concentration higher than 5 mol/L causes severe bubbling during supersonic wave application due to decomposition of hydrogen peroxide, which decreases the washing effect. In systems where other reducing agents are used, a concentration of reducing agent lower than 0.0001 mol/L gives too low dissolving ability, while a concentration higher than 0.1 mol/L may cause sedimentation of undissolved reducing agent, or may shorten the service life of the washing solution.

In a method for washing the substrate using this washing solution, the substrate can be washed with pure water shower to remove loosely sticking foreign substance, before dipping the substrate into washing solution under application of supersonic wave. There is no special limitation in the temperature during the washing, but it is preferably higher than 20° C. from the viewpoint of promoting the dissolving reaction of abrasive grains, and is preferably 20–80° C. in consideration of evaporation of the solution and other factors.

Subsequent to the washing with this washing solution, the substrate can be washed with aqueous solution of an alkaline detergent. The preferable alkaline detergents are such compounds as sodium hydroxide, potassium hydroxide, sodium carbonate, potassium carbonate, ammonia, and tetramethylammoniumhydroxide. The alkaline detergent solution can additionally contain such agents as surfactants and chelating agents.

Using only the washing solution containing acid and reducing agent, a sufficiently smooth surface of the substrate can be obtained. However, abrasive grains possibly embedded during the polishing process into the surface layer of the glass substrate can leave in minute recesses after the dissolution of the abrasive grains by the washing solution. Washing with alkaline detergent can exert a mild etching effect on the substrate surface to level the aforementioned minute recesses, achieving a higher smoothness. Further, such effects can be also obtained as an effect to increase the washing degree of the glass substrate due to an electrostatic repelling force acting between the glass substrate and foreign substance particles deposited on the surface, and an effect to remove a deteriorated surface layer called a weathering layer.

There are no particular limitations in the concentrations of alkaline detergent, surfactant and chelating agent. However, it is preferable that an alkaline detergents is used at a concentration from 0.0001 to 5 weight %. When alkaline detergent concentration is lower than 0.0001 weight %, pH value of the aqueous solution can come close to 7 under the influence of carbon dioxide gas in the atmosphere. An alkaline detergent concentration higher than 5 weight % is not only costly in itself, but it increases the effluent treatment cost. The surfactant concentration is preferably from 0.001 to 1 weight %, and the chelating agent concentration is preferably from 0.001 to 1 weight %.

This washing process with alkaline detergent can be followed by a washing process with an aqueous solution containing hydrofluoric acid or hydrosilicofluoric acid with a pH of 1 to 4, or an aqueous solution containing fluoride compounds adjusted to a pH of 1 to 7. By this washing process, even abrasive grains deeply embedded in polishing scratch can be completely removed. Hydrofluoric acid or hydrosilicofluoric acid solution has a sufficient etching effect against glass at a pH of 1 to 4, but its etching effect becomes insufficient over pH 4. Aqueous fluorides solution adjusted to pH from 1 to 7 can be preferably prepared by adding a pH adjusting agent to aqueous solution of hydrofluoric acid, ammonium bifluoride, or silicohydrofluoric acid, thus adjusting pH to a value between 2 and 7. As the pH adjusting agent, alkali compounds or fluoride compounds can be used. Alkali compounds preferably used are at least one of such compounds as tetramethylammoniumhydroxide, sodium hydroxide, potassium hydroxide, sodium carbonate, potassium carbonate, or ammonia. Fluoride compounds preferably used are at least one of such compounds as sodium fluoride, potassium fluoride, ammonium fluoride, ammonium borofluoride, or ammonium silicofluoride. Addition of pH adjusting agents provides the washing solution with a sufficient etching ability against glass at a pH of 2 to 7, the glass etching effect becoming insufficient over pH 7.

As the pH adjusting agent, alkali compounds or fluoride compounds can be used. Alkali compounds preferably used are at least one of such compounds as tetramethylammoniumhydroxide, sodium hydroxide, potassium hydroxide, sodium carbonate, potassium carbonate, or ammonia. Fluoride compounds preferably used are at least one of such compounds as sodium fluoride, potassium fluoride, ammonium fluoride, ammonium borofluoride, or ammonium silicofluoride. Addition of pH adjusting agents provides the washing solution with a sufficient etching ability against glass at a pH of 2 to 7, the glass etching effect becoming insufficient over pH 7.

EXAMPLES

The invention will be described more specifically in the following, with reference to examples and comparative examples.

Examples 1–64 i) A glass substrate having a composition: 66.0 mol % of $SiO_2$, 11.0 mol % of $Al_2O_3$, 8.0 mol % of $Li_2O$, 9.1 mol % of $Na_2O$, 2.4 mol % of MgO, and 3.6 mol % of CaO was polished using a cerium oxide-based abrasive (Mirek SOS available from Mitsui Kinzoku Kogyo Co., Ltd.) and a suede pad, followed by a washing with pure water shower to remove abrasive grains loosely sticking to the substrate surface.

ii) Subsequently, the substrate was dipped in washing solutions containing acid and reducing agent of kinds and concentrations shown in Tables 1–4 at temperatures shown in Tables 1–4 for 3 minutes, was subjected to a supersonic wave of about 48 kHz and 1 W/cm$^2$ for 3 minutes, and thereafter was pulled out and rinsed in pure water bath to remove washing solution.

iii) Then, the substrate was dipped in a bath of commercial alkaline detergent (RB25 having a pH of 11, available from Chemical Products Co., Ltd.) diluted by 50 times with pure water for 3 minutes at a temperature of 50° C., was subjected to a supersonic wave of 48 kHz and 1 W/cm$^2$ for 3 minutes, and thereafter was pulled out and rinsed in pure water bath to remove alkaline detergent. However, Example 59 had no alkaline washing of step iii).

iv) In Examples 60, 61, and 62, following the alkaline washing of step iii), the substrate was dipped in an aqueous solution of 0.001% hydrofluoric acid (Example 60), in an aqueous solution of 0.01% hydrofluoric acid and 0.5% ammonium fluoride (Example 61), or in an aqueous solution of 0.01% silicohydrofluoric acid (Example 62), respectively, at a temperature of 50° C. for 3 minutes, was subjected to a supersonic wave of 48 kHz and 1 W/cm$^2$ for 3 minutes, and thereafter was pulled out and rinsed in pure water bath. In other examples (Examples 1–59, 63, 64), this acid washing of step iv) was not carried out.

v) Then, a rinsing operation in which the substrate was dipped in a pure water bath was repeated for 3 times. Finally, the substrate was dipped in an isopropyl alcohol bath under application of a supersonic wave of about 48 kHz and 1 W/cm$^2$ for 2 minutes, thereafter the substrate being dried in isopropyl alcohol vapor. Thus obtained substrates were provided as samples for Examples 1–64.

A total reflection XF determination was carried out on respective samples for quantitative analysis of residual Ce, La, and Nd quantity (molecules/cm$^2$), of which conditions were as follows:

Apparatus: Total reflection fluorescence X-ray analysis apparatus TREX 601T available from Technos Co., Ltd.

Analyzing area: 1 cmΦ

X ray penetration depth: about 50–100 Å

Other analyzing conditions: Target (tungsten), detector (Si(Li) SSD), voltage (30 kV), current (100 mA), incident angle (0.05 deg.), measuring time (500 sec.)

The substrate surface after the washing process was observed using Nano Scope IIIa available from Digital Instrument Co., in tapping mode (a mode in which short needle vibrates at resonant frequency), of which conditions were as follows:

Measurement: Surface roughness (Ra)

Scanning area: 10 $\mu$m×10 $\mu$m

Number of Scanning lines: 256 lines for Y direction scanning

Correction: X, Y directions plane fit auto-correction

X, Y direction plane fit auto-correction was used in order to remove the image distortion in X, Y directions. An average of Z values in X axis and Y axis directions were obtained using data from all data points. Based on the obtained averages, optimum curves of second order in X, Y directions were calculated, which were subtracted from all X, Y lines. In addition, a noise removal or smoothing operation was carried out using a low-pass correction in which intensity of an image pixel is replaced with a weighted average of 8 pixels surrounding the image pixel. Further, the glass substrate samples were checked visually for occurrence of weathering.

The results are shown in Tables 1–4.

Comparative Example 1

The same determination was carried out on a substrate with which abrasive grains were removed in the same manner as in the aforementioned step i) in Example 1 but subsequent washing process was completely omitted.

Comparative Example 2

A substrate was prepared in the same manner as in Example 60 except that the washing solution contained no reducing agent and that the hydrofluoric acid treatment was omitted.

Comparative Example 3

A substrate was prepared in the same manner as in Example 60 except that the washing solution contained no reducing agent.

Comparative Example 4

A substrate was prepared in the same manner as in Example 60 except that the washing solution contained no reducing agent and that the hydrofluoric acid concentration in the washing solution was 0.1%.

Comparative Example 5

A substrate was prepared in the same manner as in Example 59 except that the washing solution contained no reducing agent. This preparation corresponds to Comparative Example 2 dispensed with the alkaline solution treatment.

Comparative Example 6

A substrate was prepared in the same manner as in Example 60 except that the washing solution contained no reducing agent and that the alkaline solution treatment was omitted. This preparation corresponds to Comparative Example 3 dispensed with the alkaline solution treatment.

Comparative Example 7

A substrate was prepared in the same manner as in Example 60 except that the washing solution contained no reducing agent, that the alkaline solution treatment was omitted, and that the hydrofluoric acid concentration in the washing solution was 0.1%. This preparation corresponds to Comparative Example 4 dispensed with the alkaline solution treatment.

The evaluation results of Example 1–7 are shown in Table 4.

As apparent from Tables 1–4, the substrates obtained in Examples 1–64 have high cleanliness with extremely small residual quantity of lanthanoid oxides, while the values for surface roughness are small. Particularly, when ascorbic acid is used as reducing agent, a small addition of the agent gives an excellent lanthanoid oxides removal effect, while the surface roughness value is small.

From the comparison of Examples 59–62 with Comparative Examples 2–4, it is found that addition of reducing agent to the washing solution gives a remarkably decreased residual quantity of lanthanoid oxides. Further, from the comparison of Examples 59–62 with corresponding comparative examples, it is known that the etching treatment with alkaline solution and fluoric solution gives a remarkably decreased residual quantity of lanthanoid oxides.

From the comparison of Examples 59–62 with Comparative Examples 2–4, and Comparative Examples 5–7, it is found that omitting of acid washing after alkali washing certainly causes occurrence of weathering of glass surface.

TABLE 1

| | washing conditions of substrates | | | | | | | estimation | | | | |
|---|---|---|---|---|---|---|---|---|---|---|---|---|
| | acid solution treatment, for 3 min. | | | | treating | alkaline | etching treat- | residual | | | surface | weath- |
| | acid | | reducing agent | | temper- | solution | ment in fluor- | lanthanoide | | | roughness | ering |
| | kinds | concentration mol/L | kinds | concentration mol/L | ature ° C. | treatment (50° C., 3 min) | ide solution (50° C., 3 min) | Ce ×E10 atoms/cm$^2$ | La | Nd | AFM Ra(nm) | of glass |
| Examples | | | | | | | | | | | | |
| 1 | $HNO_3$ | 10.0 | hydrogen peroxide | 1.0 | 30.0 | RB25 | no | 0.0 | 0.0 | 0.0 | 0.22 | no |
| 2 | | 1.0 | | 1.0 | 60.0 | RB25 | no | 0.0 | 0.0 | 0.0 | 0.22 | |
| 3 | | 0.1 | | 1.0 | 60.0 | RB25 | no | 0.2 | 0.1 | 0.0 | 0.23 | |
| 4 | | 0.0 | | 1.0 | 60.0 | RB25 | no | 0.3 | 0.1 | 0.1 | 0.23 | |
| 5 | | 0.0 | | 1.0 | 60.0 | RB25 | no | 0.5 | 0.2 | 0.1 | 0.22 | |
| 6 | $H_2SO_4$ | 10.0 | | 1.0 | 30.0 | RB25 | no | 0.0 | 0.0 | 0.0 | 0.21 | |
| 7 | | 1.0 | | 1.0 | 60.0 | RB25 | no | 0.0 | 0.0 | 0.0 | 0.23 | |
| 8 | | 0.1 | | 1.0 | 60.0 | RB25 | no | 0.0 | 0.0 | 0.0 | 0.22 | |
| 9 | | 0.0 | | 1.0 | 60.0 | RB25 | no | 0.3 | 0.1 | 0.0 | 0.23 | |
| 10 | | 0.0 | | 1.0 | 60.0 | RB25 | no | 0.4 | 0.3 | 0.1 | 0.24 | |
| 11 | sulfamic acid | 10.0 | | 1.0 | 30.0 | RB25 | no | 0.0 | 0.0 | 0.0 | 0.23 | |
| 12 | | 1.0 | | 1.0 | 60.0 | RB25 | no | 0.0 | 0.0 | 0.0 | 0.23 | |
| 13 | | 0.1 | | 1.0 | 60.0 | RB25 | no | 0.0 | 0.0 | 0.0 | 0.22 | |
| 14 | | 0.0 | | 1.0 | 60.0 | RB25 | no | 0.2 | 0.1 | 0.0 | 0.22 | |
| 15 | | 0.0 | | 1.0 | 60.0 | RB25 | no | 0.5 | 0.3 | 0.2 | 0.21 | |

TABLE 2

| | washing conditions of substrates | | | | | | | estimation | | | | |
|---|---|---|---|---|---|---|---|---|---|---|---|---|
| | acid solution treatment, for 3 min. | | | | | alkaline | etching treatment | | | | surface | |
| | acid | | reducing agent | | treating | solution | in fluoride | residual | | | rough- | weath- |
| | | concen- | | concen- | temper- | treatment | solution | lanthanoide | | | ness | ering |
| | kinds | tration mol/L | kinds | tration mol/L | ature ° C. | (50° C., 3 min) | (50° C., 3 min) | Ce xE10 atoms/cm$^2$ | La | Nd | AFM Ra(nm) | of glass |
| Examples | | | | | | | | | | | | |
| 16 | $HNO_3$ | 1.0 | hydrogen | 0.5 | 60.0 | RB25 | no | 0.1 | 0.0 | 0.0 | 0.23 | no |
| 17 | | 1.0 | hydrogen peroxide | 5.0 | 60.0 | RB25 | no | 0.0 | 0.0 | 0.0 | 0.24 | |
| 18 | | 1.0 | hydrogen peroxide | 0.5 | 60.0 | RB25 | no | 0.1 | 0.0 | 0.0 | 0.21 | |
| 19 | | 1.0 | boron sodium hydroxide | 0.005 | 60.0 | RB25 | no | 0.1 | 0.0 | 0.0 | 0.24 | |
| 20 | | 1.0 | hydroxylamine sulfate | 0.05 | 60.0 | RB25 | no | 0.1 | 0.0 | 0.0 | 0.23 | |
| 21 | | 1.0 | hydroxylamine hydrochloride | 0.05 | 60.0 | RB25 | no | 0.1 | 0.0 | 0.0 | 0.24 | |
| 22 | | 1.0 | sodium nitrite | 0.1 | 60.0 | RB25 | no | 0.0 | 0.0 | 0.0 | 0.22 | |
| 23 | | 1.0 | sodium nitrite | 0.0001 | 60.0 | RB25 | no | 0.0 | 0.0 | 0.0 | 0.23 | |
| 24 | | 1.0 | sodium nitrite | 0.01 | 60.0 | RB25 | no | 0.1 | 0.0 | 0.0 | 0.22 | |
| 25 | | 1.0 | sodium bisulfite | 0.01 | 60.0 | RB25 | no | 0.1 | 0.0 | 0.0 | 0.23 | |
| 26 | | 1.0 | sodium bisulfate | 0.01 | 60.0 | RB25 | no | 0.1 | 0.0 | 0.0 | 0.24 | |
| 27 | | 1.0 | sodium sulfide | 0.001 | 60.0 | RB25 | no | 0.0 | 0.0 | 0.0 | 0.23 | |
| 28 | | 1.0 | ammonium sulfide | 0.01 | 60.0 | RB25 | no | 0.1 | 0.0 | 0.0 | 0.23 | |
| 29 | | 1.0 | formic acid | 0.02 | 60.0 | RB25 | no | 0.1 | 0.0 | 0.0 | 0.22 | |
| 30 | | 1.0 | ascorbis acid | 0.01 | 60.0 | RB25 | no | 0.0 | 0.0 | 0.0 | 0.21 | |
| 31 | | 1.0 | oxalic acid | 0.5 | 60.0 | RB25 | no | 0.0 | 0.0 | 0.0 | 0.21 | |
| 32 | | 1.0 | aceteldehyde | 0.01 | 60.0 | RB25 | no | 0.1 | 0.0 | 0.0 | 0.24 | |
| 33 | | 1.0 | hydrogen iodide | 0.05 | 60.0 | RB25 | no | 0.1 | 0.0 | 0.0 | 0.23 | |
| 34 | | 1.0 | sodium hydrogen phosphate | 0.005 | 60.0 | RB25 | no | 0.1 | 0.0 | 0.0 | 0.22 | |
| 35 | | 1.0 | disodium hydrogen phosphate | 0.008 | 60.0 | RB25 | no | 0.1 | 0.0 | 0.0 | 0.23 | |
| 36 | | 1.0 | sodium phosphite | 0.01 | 60.0 | RB25 | no | 0.0 | 0.0 | 0.0 | 0.24 | |
| 37 | | 1.0 | ferrous sulfate | 0.01 | 60.0 | RB25 | no | 0.0 | 0.0 | 0.0 | 0.23 | |
| 38 | | 1.0 | tin(IV) chloride | 0.01 | 60.0 | RB25 | no | 0.1 | 0.0 | 0.0 | 0.23 | |

TABLE 3

| | washing conditions of substrates | | | | | | | estimation | | | | |
|---|---|---|---|---|---|---|---|---|---|---|---|---|
| | acid solution treatment, for 3 min. | | | | | alkaline | etching treatment | | | | surface | |
| | acid | | reducing agent | | treating | solution | in fluoride | residual | | | rough- | weath- |
| | | concen- | | concen- | temper- | treatment | solution | lanthanoide | | | ness | ering |
| | kinds | tration mol/L | kinds | tration mol/L | ature ° C. | (50° C., 3 min) | (50° C., 3 min) | Ce xE10 atoms/cm$^2$ | La | Nd | AFM Ra(nm) | of glass |
| Examples | | | | | | | | | | | | |
| 39 | $H_2SO_4$ | 1.0 | hydrogen | 0.15 | 60.0 | RB25 | no | 0.2 | 0.0 | 0.0 | 0.23 | no |
| 40 | | 1.0 | hydrogen peroxide | 0.3 | 60.0 | RB25 | no | 0.0 | 0.0 | 0.0 | 0.26 | |
| 41 | | 1.0 | boron sodium hydroxide | 0.005 | 60.0 | RB25 | no | 0.0 | 0.0 | 0.0 | 0.21 | |
| 42 | | 1.0 | hydroxylamine sulfate | 0.05 | 60.0 | RB25 | no | 0.0 | 0.0 | 0.0 | 0.23 | |
| 43 | | 1.0 | hydroxylamine hydrochloride | 0.05 | 60.0 | RB25 | no | 0.3 | 0.1 | 0.0 | 0.24 | |
| 44 | | 1.0 | sodium nitrite | 0.01 | 60.0 | RB25 | no | 0.2 | 0.1 | 0.0 | 0.24 | |
| 45 | | 1.0 | sodium bisulfite | 0.01 | 60.0 | RB25 | no | 0.0 | 0.0 | 0.0 | 0.23 | |
| 46 | | 1.0 | sodium bisulfate | 0.01 | 60.0 | RB25 | no | 0.0 | 0.0 | 0.0 | 0.23 | |
| 47 | | 1.0 | sodium sulfide | 0.001 | 60.0 | RB25 | no | 0.0 | 0.0 | 0.0 | 0.24 | |
| 48 | | 1.0 | ammonium sulfide | 0.01 | 60.0 | RB25 | no | 0.0 | 0.0 | 0.0 | 0.22 | |
| 49 | | 1.0 | formic acid | 0.02 | 60.0 | RB25 | no | 0.2 | 0.1 | 0.0 | 0.23 | |
| 50 | | 1.0 | ascorbis acid | 0.01 | 60.0 | RB25 | no | 0.0 | 0.0 | 0.0 | 0.22 | |
| 51 | | 1.0 | oxalic acid | 0.5 | 60.0 | RB25 | no | 0.0 | 0.0 | 0.0 | 0.24 | |
| 52 | | 1.0 | acetaldehyde | 0.01 | 60.0 | RB25 | no | 0.4 | 0.2 | 0.1 | 0.23 | |
| 53 | | 1.0 | hydrogen iodide | 0.05 | 60.0 | RB25 | no | 0.5 | 0.2 | 0.1 | 0.23 | |
| 54 | | 1.0 | sodium hydrogen phosphate | 0.005 | 60.0 | RB25 | no | 0.3 | 0.2 | 0.0 | 0.23 | |

TABLE 3-continued

| | washing conditions of substrates | | | | | | | estimation | | | | |
|---|---|---|---|---|---|---|---|---|---|---|---|---|
| | acid solution treatment, for 3 min. | | | | | alkaline | etching treatment | | | | surface | |
| | acid | | reducing agent | | treating | solution | in fluoride | residual | | | rough- | weath- |
| | | concen- | | concen- | temper- | treatment | solution | lanthanoide | | | ness | ering |
| | kinds | tration mol/L | kinds | tration mol/L | ature ° C. | (50° C., 3 min) | (50° C., 3 min) | Ce xE10 atoms/cm$^2$ | La | Nd | AFM Ra(nm) | of glass |
| 55 | | 1.0 | disodium hydrogen phosphate | 0.008 | 60.0 | RB25 | no | 0.2 | 0.1 | 0.0 | 0.22 | |
| 56 | | 1.0 | sodium phosphite | 0.01 | 60.0 | RB25 | no | 0.4 | 0.2 | 0.1 | 0.22 | |
| 57 | | 1.0 | ferrous sulfate | 0.01 | 60.0 | RB25 | no | 0.3 | 0.1 | 0.0 | 0.23 | |
| 58 | | 1.0 | tin(IV) chloride | 0.01 | 60.0 | RB25 | no | 0.3 | 0.0 | 0.0 | 0.22 | |

TABLE 4

| | washing conditions of substrates | | | | | | | estimation | | | | |
|---|---|---|---|---|---|---|---|---|---|---|---|---|
| | acid solution treatment, for 3 min. | | | | | alkaline | etching | | | | surface | |
| | acid | | reducing agent | | treating | solution | treatment | residual | | | rough- | weath- |
| | | concen- | | concen- | temper- | treatment | in fluoride | lanthanoide | | | ness | ering |
| | kinds | tration mol/L | kinds | tration mol/L | ature ° C. | (50° C., 3 min) | solution (50° C., 3 min) | Ce xE10 atoms/cm$^2$ | La | Nd | AFM Ra(nm) | of glass |
| Examples | | | | | | | | | | | | |
| 59 | $HNO_3$ | 0.1 | hydrogen peroxide | 1.0 | 60.0 | no | no | 0.5 | 0.3 | 0.2 | 0.24 | yes |
| 60 | | 0.1 | hydrogen peroxide | 1.0 | 60.0 | RB25 | 0.001% HF | 0.0 | 0.0 | 0.0 | 0.23 | no |
| 61 | | 0.1 | hydrogen peroxide | 1.0 | 60.0 | RB25 | 0.1% HF + 0.5% $NH_4F$ | 0.0 | 0.0 | 0.0 | 0.21 | |
| 62 | | 0.1 | hydrogen peroxide | 1.0 | 60.0 | RB25 | 0.01% $H_2SiF_6$ | 0.0 | 0.0 | 0.0 | 0.22 | |
| 63 | HNO3/ | 1.0 | hydrogen peroxide | 1.0 | 60.0 | RB25 | no | 0.1 | 0.0 | 0.0 | 0.23 | |
| 64 | $H_2SO_4$ = 1/1 | 0.1 | hydrogen peroxide | 1.0 | 60.0 | RB25 | no | 0.5 | 0.0 | 0.0 | 0.22 | |
| Comparative examples | | | | | | | | | | | | |
| 1 | — | — | — | — | — | no | no | 203.3 | 128.9 | 44.2 | 0.24 | |
| 2 | $HNO_3$ | 0.1 | — | — | 60.0 | RB25 | no | 148.1 | 94.4 | 33.7 | 0.25 | |
| 3 | $HNO_3$ | 0.1 | — | — | 60.0 | RB25 | 0.001% HF | 61.5 | 38.1 | 13.2 | 0.55 | |
| 4 | $HNO_3$ | 0.1 | — | — | 60.0 | RB25 | 0.1% HF | 28.7 | 19.6 | 6.9 | 0.69 | |
| 5 | $NHO_3$ | 0.1 | — | — | 60.0 | no | no | 196.2 | 124.6 | 44.1 | 0.24 | yes |
| 6 | $NHO_3$ | 0.1 | — | — | 60.0 | no | 0.001% HF | 89.9 | 55.0 | 20.1 | 0.45 | yes |
| 7 | $NHO_3$ | 0.1 | — | — | 60.0 | no | 0.1% HF | 55.1 | 37.9 | 13.0 | 0.57 | yes |

In addition, it is found from experiment results that the washing solution containing nitric acid and ascorbic acid gave a higher dissolving rate of lanthanoid oxides than other combinations.

The further items obtained from the experiment results are as follows:

1) Lanthanoid oxides are dissolved easier in nitric acid than in sulfuric acid.

2) The addition of reducing agents promotes the dissolution of lanthanoid oxides in acid solution, but in this case too, a nitric acid-based solution dissolves lanthanoid oxides more easily than a sulfuric acid-based solution.

3) The order of lanthanoid oxides dissolving ability of reducing agents is ascorbic acid>>hydrogen peroxide.

4) A system containing ascorbic acid has an equivalent dissolving ability at 1/10 of acid concentration when compared with a solution containing hydrogen peroxide.

5) Omitting of alkali washing after acid washing causes occurrence of weathering of glass surface.

As apparent from the above description, the present invention provides a substrate with high cleanliness having an extremely low residual quantity of lanthanoid oxides. In addition, the weathering of glass surface is prevented from occurring by carrying out the alkali washing after the acid washing.

What is claimed is:

1. A method for cleaning a glass substrate, comprising:

a polishing process of polishing the glass substrate with an abrasive containing lanthanoid oxides, a first washing process of washing the polished substrate with a washing solution containing acid and a reducing agent, said acid including at least nitric acid, and a second washing process of washing the washed substrate with an aqueous solution of an alkaline detergent.

2. A method for cleaning a glass substrate according to claim 1, wherein the reducing agent is a chelating agent having a reducing property.

3. A method for cleaning a glass substrate according to claim 1, wherein a concentration of the alkaline detergent is from 0.0001 to 5 wt %.

4. A method for cleaning a glass substrate according to claim 1, further comprising a third washing process of washing the substrate with an aqueous solution of hydrofluoric acid or silicohydrofluoric acid having a pH of 1 to 4, or an aqueous solution of fluoride compounds adjusted to a pH of 1 to 7, said third washing process being conducted after said second washing process.

5. A method for cleaning a glass substrate according to claim 1, wherein the acid in said washing solution containing acid and reducing agent further includes at least one acid selected from sulfuric acid, hydrochloric acid, sulfamic acid, and phosphoric acid, and that an acid concentration in said washing solution is from 0.001 to 10 mol/L.

6. A method for cleaning a glass substrate according to claim 5, wherein the acid concentration is from 0.001 to 0.5 mol/L.

7. A method for cleaning a glass substrate according to claim 1, wherein a reducing agent concentration in said washing solution is from 1 to 5 mol/L for hydrogen peroxide and from 0.0001 to 0.1 mol/L for other reducing agents.

8. A method for cleaning a glass substrate according to claim 1, wherein the reducing agent is at least one selected from hydrogen, boron sodium hydroxide, hydroxylamin sulfate, hydroxylamin hydrochloride, sodium nitrite, sodium sulfite, sodium bisulfite, sodium bisulfate, sodium sulfide, ammonium sulfide, formic acid, ascorbic acid, oxalic acid, acetaldehyde, hydrogen iodide, sodium hydrogen phosphate, disodium hydrogen phosphate, sodium phosphite, ferrous sulfate, and tin(IV) chloride, and that a concentration of the reducing agent in the washing solution is from 0.0001 to 0.1 mol/L.

9. A method for cleaning a glass substrate according to claim 8, wherein the reducing agent is ascorbic acid.

* * * * *